US008292062B2

(12) United States Patent
Stauber et al.

(10) Patent No.: US 8,292,062 B2
(45) Date of Patent: Oct. 23, 2012

(54) METHOD AND DEVICE FOR CONVEYING PLANAR PRODUCTS

(75) Inventors: Hans Ulrich Stauber, Grut (CH); Konrad Auf der Maur, Gossau (CH)

(73) Assignee: Ferag AG, Hinwil (CH)

( * ) Notice: Subject to any disclaimer, the term of this patent is extended or adjusted under 35 U.S.C. 154(b) by 272 days.

(21) Appl. No.: 12/520,411

(22) PCT Filed: Dec. 6, 2007

(86) PCT No.: PCT/CH2007/000615

§ 371 (c)(1),
(2), (4) Date: Jun. 19, 2009

(87) PCT Pub. No.: WO2008/077260

PCT Pub. Date: Jul. 3, 2008

(65) Prior Publication Data

US 2010/0012461 A1 Jan. 21, 2010

(30) Foreign Application Priority Data

Dec. 22, 2006 (CH) ..... 2089/06

(51) Int. Cl.
*B65G 47/26* (2006.01)

(52) U.S. Cl. ..... 198/418.9; 198/644; 198/418.8; 271/252; 271/285

(58) Field of Classification Search ..... 198/418.9, 198/644, 440, 470.1, 418.8, 456; 271/85, 271/252, 286, 285
See application file for complete search history.

(56) References Cited

U.S. PATENT DOCUMENTS

| | | | | |
|---|---|---|---|---|
| 3,032,341 | A | 5/1962 | Reist | |
| 3,636,828 | A * | 1/1972 | Achelpohl | 198/418.9 |
| 4,482,139 | A * | 11/1984 | Killer | 198/418 |
| 6,003,859 | A * | 12/1999 | Reist | 198/644 |
| 6,672,447 | B2 * | 1/2004 | Muller | 271/85 |
| 6,951,272 | B2 * | 10/2005 | Ohno et al. | 198/644 |
| 6,976,674 | B2 * | 12/2005 | Honegger | 198/470.1 |
| 7,150,454 | B2 * | 12/2006 | Honegger | 271/204 |
| 2005/0139454 | A1 * | 6/2005 | Ohno et al. | 198/644 |

FOREIGN PATENT DOCUMENTS

| | | |
|---|---|---|
| CH | 634530 | 2/1983 |
| DE | 2417614 | 10/1975 |

(Continued)

*Primary Examiner* — James R Bidwell
(74) *Attorney, Agent, or Firm* — Rankin, Hill & Clark LLP

(57) ABSTRACT

A method and a device for the conveyance of planar products (10, 10', 20, 20'), in particular printed products, are provided wherein a product group (100) composed of at least two products (10, 10', 20, 20') is gripped by a gripper (42) in the area of a product edge (12, 12', 22, 22') and conveyed in a direction of conveyance (F2). At least one of the products (10, 10', 20, 20') is displaced relative to the other product or products (10, 10', 20, 20') in the product group (100) in a direction of displacement (A) defined by the gripped product edge (12, 12', 22, 22'), such that in each case a projection (14, 24) is formed in the direction of displacement (A). Thus a first projection (14) is associated with at least one displaced product (10, 10', 20, 20') and a second projection (24) is associated with the remaining product or products (10, 10', 20, 20') of the product group (100). Thus, it is easy to increase the carrying capacity of a gripper conveyor and, when applicable, to easily separate the products that are gripped in groups.

22 Claims, 7 Drawing Sheets

FOREIGN PATENT DOCUMENTS

| | | |
|---|---|---|
| DE | 2922450 | 1/1980 |
| EP | 0330868 | 9/1989 |
| EP | 0936169 | 8/1999 |
| EP | 1321410 | 6/2003 |
| WO | 00/24660 | 5/2000 |
| WO | 03/053831 | 7/2003 |

* cited by examiner

Fig.6b
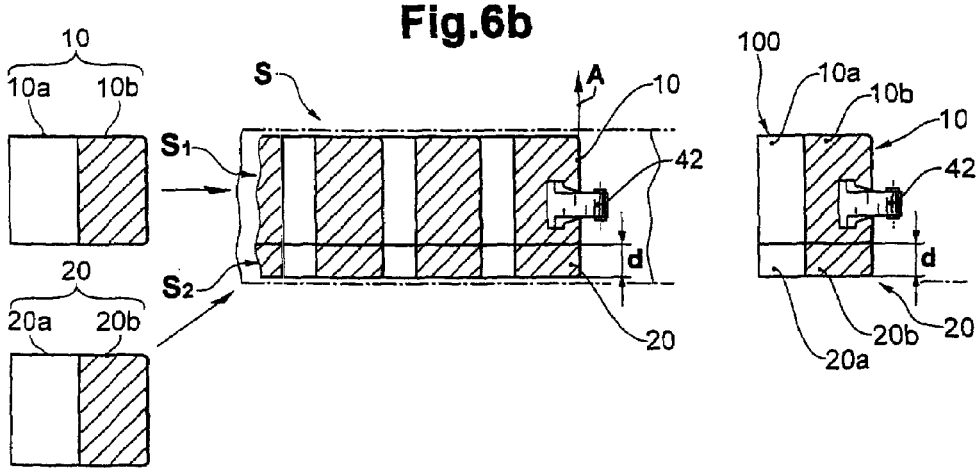
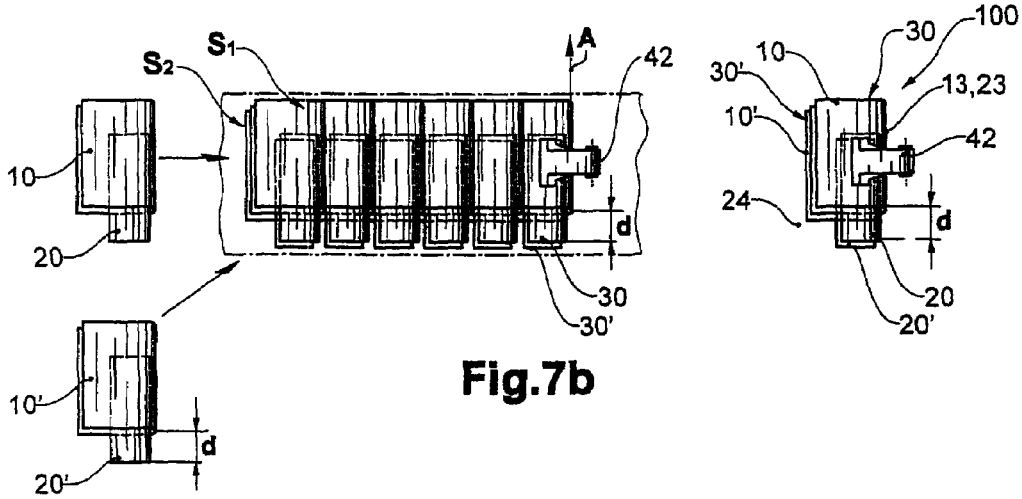
Fig.7b
Fig.7a
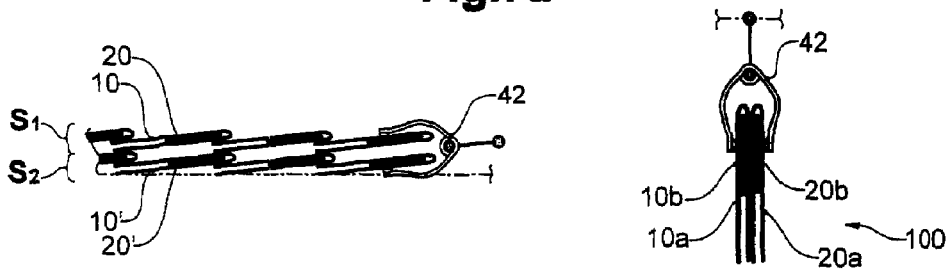
Fig.8
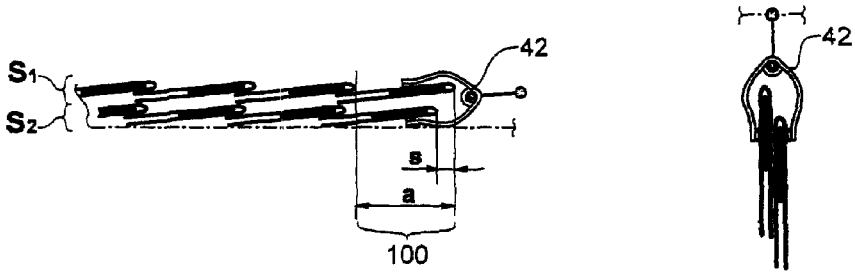

METHOD AND DEVICE FOR CONVEYING PLANAR PRODUCTS

BACKGROUND OF THE INVENTION

Field of the Invention

The invention pertains to the field of conveyance technology for planar products, in particular to the field of handling printed products.

The capacity of rotary printing presses has steadily increased in recent years. At present, an output on the order of about 170,000 copies per hour is possible. This places higher demands on the post-processing operations. In order to convey the products to a post-processing operation, for example the insertion of supplements, addressing, etc., it is necessary to convey the products in an imbricated stream by means of a conveyor belt, and/or to transfer them singly to a gripping device and thereby transport them further. Intermediary steps such as buffering in a storage winding roll or the arrangement of the product into stacks or piles can be interposed.

At present, gripper conveyors still have difficulty achieving the conveying rates described above. Yet, it is often desired to convey the product with a gripper conveyor, as the gripper conveyor makes possible precise, defined handling and is more appropriate than a conveyor belt for conveying products at higher speeds and over longer distances. A gripper conveyor also makes possible the individual selection of products, for example for the introduction of supplementary materials, or the application of address labels, or also in order to alter the formation of an original imbricated formation. The latter is above all of interest if an existing imbricated formation does not have the appropriate configuration for the post-processing operations, e.g. with the leading edges underneath rather than on top of a trailing product, folded edges trailing rather than leading.

It is disclosed in e.g. DE-A 2417614 or CH 634 530 that rotary printing presses deliver folded products in pairs in an imbricated stream with folded edges leading, wherein in each case a product of a pair of products is arranged within the other product, however in each case with a lateral displacement with respect to this other product in the direction of their respective folded edges. The pairs are subsequently pulled apart from each other in the direction of displacement, being gripped in each case in the area of the product which projects laterally past the respective other product (hereafter referred to as the projection). This creates two imbricated streams, each with half of the original conveying rate. In general, these can without difficulty be further conveyed by means of a conventional gripper conveyor.

It is disclosed in EP-A 0 936 169 how a simple imbricated stream may be converted, by means of a deflection transverse to its direction of conveyance, into an imbricated stream in which in each case two products lie side by side and overlap. In each case two conveyed products which originally are situated one in front of the other come to be situated side by side in the outgoing imbricated stream, wherein the previously leading product is oriented sideways. The pair are subsequently separated, again by their products being gripped on the projections. Again, two imbricated streams result, each with half of the original conveying rate.

It is disclosed in WO 00/24660, EP-A 1 321 410 or EP-A 0 330 868, that a gripper of a gripper conveyor grips and conveys two products together. The products have a displacement in a direction that runs transversely to the edge being gripped. As a consequence, the conveyance rate is doubled with the same speed of the gripper. The separation of the products in a following work step presupposes, however, that once again a conveyor with the original delivery rate is employed. EP-A 1 321 410 describes, for example, that the initially pairwise gripped products are transferred individually into the grippers of a single further conveyor. This must again have the original conveying rate, which in the event of the high rate counts described initially above is not feasible.

In the course of increasing the delivery capacity of rotary printing presses, a need has been created for a conveyance method using gripper conveyors that can cope with the increased rate counts and that preferentially is achievable with limited technical costs. It is an object of the invention to provide such a conveyance method and a device appropriate to the execution of that method.

BRIEF SUMMARY OF THE INVENTION

In method according to the invention for the conveyance of planar products, in particular printed products, a product group consisting of at least two gripped-together products is gripped by a gripper of a gripper conveyor and conveyed in a direction of conveyance. Usually it is applied to products that are rectangular in shape, wherein all product edges run parallel to one another or stand perpendicular to one another. The gripper grips the products together, such that all the products are held. The product edge that next comes to the gripper will be designated as the gripped product edge. According to the invention, at least one of the products within the product group is shifted in a direction of displacement relative to the other product or products of the product group, such that in each case an area of the outside-lying product protrudes past the other product or products. In what follows, this area of the product will be also called the projection. The direction of displacement corresponds to the direction of the gripped product edge or edges. It preferentially, though not necessarily, runs perpendicularly to the direction of conveyance of the gripper conveyor.

In the case of folded products, they are displaced relative to one another in the direction of the folded edge; in the case of products with multiple folds, in the direction of the outermost fold. The folded edge is preferentially, though not necessarily, gripped by the gripper. In this embodiment of the invention, the folded edge, thus, determines the direction of displacement.

The device according to the invention includes an incoming conveyor for the incoming conveyance of products as well as a gripper conveyor, which is capable of gripping and conveying each respective product group thereof in such a manner that at least one of the products of a product group is displaced relative to the other product or products of the product group in the direction of the gripped product edge or the folded edge. DE-A 292 2450 discloses an example of such a device.

The invention makes it possible to easily double or even multiply the conveying capacity of known gripper conveyors, in that groups of products are gripped together by one gripper. By being taken up by the gripper, the products can also be moved in a precise and controlled manner over large distances. Preferentially, the products are arranged in the group such that the edges of at least two products are aligned flush relative to one another. Preferentially, one of these edges is the gripped product edge. The products thereby occupy a defined space and can be held in an especially reliable way. The projections at the pairs or groups of products, which extend in the direction of displacement beyond the area in which the products overlap each other completely, make it possible to easily separate the products again by gripping the projections and moving, wherein a component of that movement is in the direction of displacement. Preferentially, this occurs after the products have been laid on a conveyor belt in imbricated formation or as separated pairs or, as the case may be, groups. At this juncture it is possible to compose a product formation that is customized to the requirements of a post-production process.

An example of such a separation step can be found as disclosed in DE-A 2417614, CH 634 530 or EP-A 0 936 169. It creates two imbricated streams, each respectively with half of the original delivery capacity. According to the device, there is preferentially an outgoing conveyor which is capable of taking the products from the gripper conveyor and conveying them in a continuous imbricated stream in an outgoing direction of conveyance. For the separation into two sub-streams the outgoing conveyor preferentially comprises a holding means that grips onto the projections, holds them and moves in a direction, wherein a component of this movement is in the direction of displacement.

The products within a product group can be identical to one another or variable, as well as also having different formats. This can, for example, be a matter of multiple magazines or kerfs, or one magazine with additional inserts. The products can be unfolded, however with printed products it is generally concerned with folded products. In this case, the direction of displacement preferentially corresponds to the direction of the folded edge. In the case of a product with multiple folds, the 'folded edge' is taken in each case to mean the last appropriate folded edge. In the case that multiple products in a product group are folded, the folded edges point preferentially, though not necessarily, in the same direction.

If there are only two products in a product group, the group may also be designated as a product pair. Preferentially a gripper grips two or more product pairs, in which the gripped product edges are arranged such that the products substantially overlap one another, or are displaced relative to one another in a direction transverse to the direction of displacement. Such a product group lends itself to easily being taken from an incoming imbricated formation and also being transferred again to an outgoing imbricated formation.

The invention makes it possible to capitalize on the fact that rotary printing presses often produce products as product pairs consisting of in each case two products that are offset relative to one another in a direction of displacement, folded in each other and aligned with one another with respect to their folded edges. Thus, according to the invention, a separation step after the printing press can be done away with, and these product pairs can be transferred immediately to the grippers.

However, the method according to the invention can also be used in cases in which the described product groups were manufactured in other ways. For example, the products that are to be taken up can be arranged in an imbricated formation that is composed upon their being taken out of an intermediate storage place which is used for intermediate storage. Moreover, it is possible that the product pairs are arranged in an imbricated formation wherein the product pairs consist of two products that lie on top of or inside of one other. Thus furthermore, it is possible to assemble the product groups by extracting products from a formation that corresponds to two or more imbricated streams that lie on top of one another, as disclosed in WO-A 03/0538131.

In a preferred embodiment of the invention, the products are conveyed in an imbricated formation to the gripper conveyor. As a preferred example, the imbricated stream already consists of product groups that are transferred to a gripper in a further step, e.g. of the above described pairs of products folded in each other with a predetermined product spacing. Alternatively, the product groups can be composed into a simple imbricated stream during the conveyance. Here may be considered the method according to EP-A 0 936 169, i.e. composition of product pairs out of an imbricated stream consisting of single products.

In a further preferred embodiment of this variant of the invention an imbricated formation consists of product pairs with a regular product spacing. These pairs are grouped into product groups in a further process step, which groups are respectively each transferred to a gripper. In particular, an imbricated formation is composed, which consists of such product groups composed of two or more product pairs, wherein the product groups comprise a regular group spacing under one another. Within a group of products, the product pairs can lie congruently or differentiated, i.e. lie on top of one another with a displacement that is greater than or equal to zero and smaller than the product spacing. Rather than pairs of products, units of more than two products can also be arranged in the described manner.

An imbricated stream of overlapping product groups is composed as disclosed for example for single products in EP-A 00139 20 or EP-A 1 321 410.

BRIEF DESCRIPTION OF THE DRAWINGS

Preferred embodiments of the invention are depicted in the figures and described thereafter. Showing in pure schematic:

FIGS. 1*i-m* examples of an imbricated formation consisting of multiple product groups;

FIG. 8 a modification of the method according to FIG. 6*a+b* or 7*a+b;*

DETAILED DESCRIPTION OF THE INVENTION

Figure 1A:
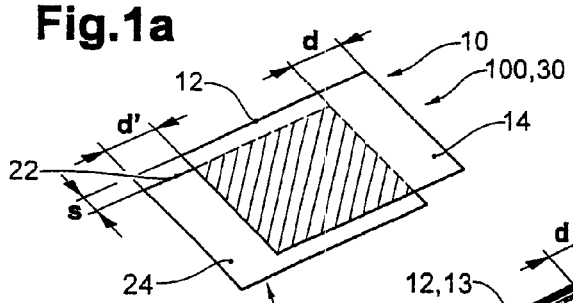
FIGS. 1*a-h* several examples of product groups of several products.
Figure 1B:
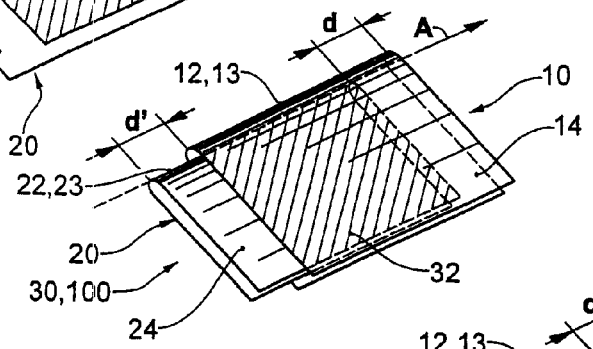
Figure 1C:
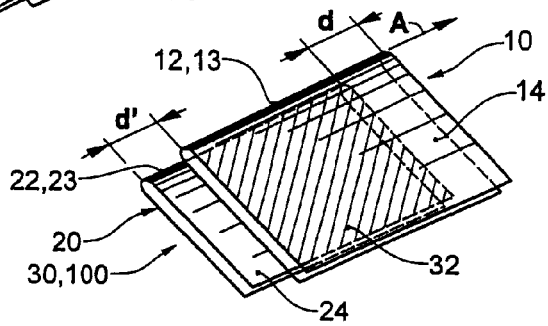
Figure 1D:
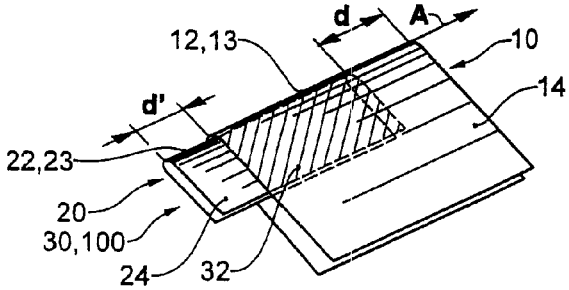
Figure 1E:
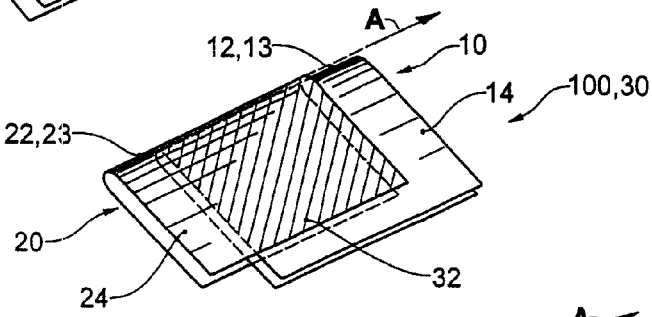
Figure 1F:
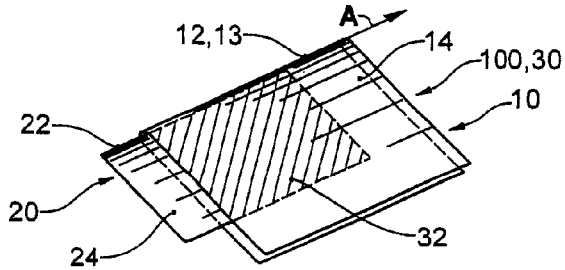
Figure 1G:
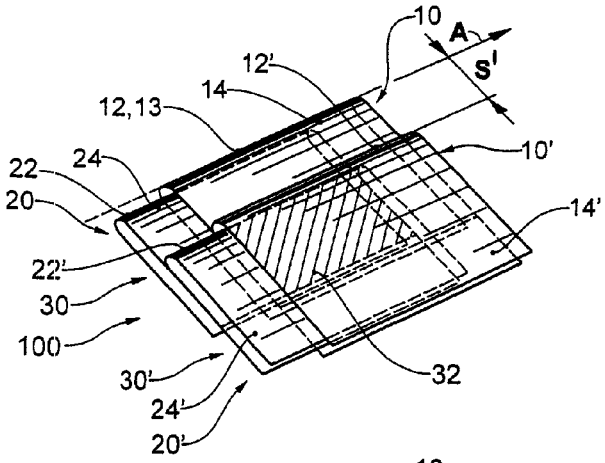
Figure 1H:
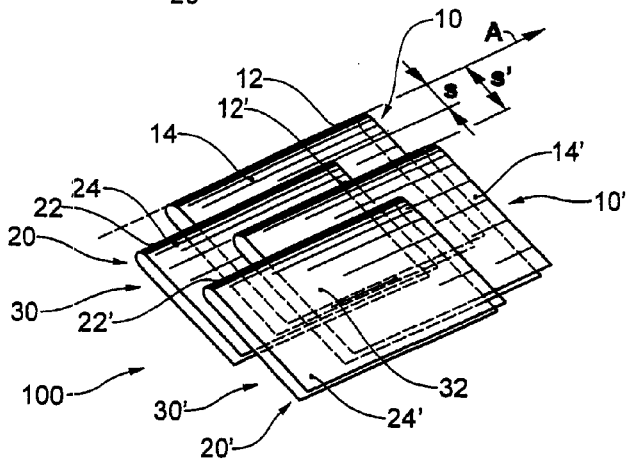

FIGS. 1*a-h* give an exemplary view of several product groups 100 in the form of product pairs 30, 30' (FIGS. 1*a-f*) or pairs of pairs (FIGS. 1*g*+*h*), which in the conveyance method according to the invention are conveyed together in one gripper. It is concerned with groups 100 of respectively two planar products 10, 10', 20, 20' with a basically rectangular shape in a defined spatial relationship with one another, i.e. with a minimum of overlap in an overlapping area 32 (represented with shading). In normal cases the product edges run parallel to one another. In the execution of the method according to the invention, in each case, one of the product edges 12, 22 of the product 10, 20 is arranged in spatial proximity to the gripper, which grips preferentially in the overlapping area 32. These product edges 12, 22, 12', 22' will also be designated as gripped product edges. According to the invention the products of a product group 100 have a displacement relative to one another in a displacement direction A defined by the gripped product edges 12, 22, 12', 22', such that in each case a lateral projection 14, 24, 14', 24' of width d or as the case may be d' is formed, wherein it is possible that d=d'. Within the product group 100 the products can have a displacement s perpendicular to the direction of displacement A (FIG. 1*a*). In the case of two product pairs 30, 30', between these a displacement s' can exist (instead of or in addition to the displacement within the pairs) perpendicular to the direction of displacement A (FIG. 1*g*, 1*h*).

FIG. 1*a* shows, in overview, the most general case of a product group 100 in the form of a pair 30 with two products 10, 20, which are folded or unfolded. According to the FIGS. 1*b*-*h* at least one product 10, 10', 20, 20' of a product group 100 is folded and comprises a folded edge 13, 13', 23, 23', which here corresponds to the gripped edge 12, 12', 22, 22'. If within a group 100, multiple folded products 10, 10', 20, 20' exist, the folded edges 13, 13', 23, 23' preferentially are parallel with one another. The displacement s within a pair is frequently zero, particularly if the products are aligned together with one another at their folded edges 13, 13', 23, 23'.

In FIG. 1*b* a product pair 30 is depicted of two similarly-sized products 10, 20 folded in with one another, whose gripped edges 12, 22, which correspond to the folded edges 13, 23, are aligned with one another. Projections 14, 24 are formed as shown in the direction of displacement A with substantially similar widths d as well as d'. Such a product group is produced by, for example, a rotary printing press as disclosed e.g. in DE-A 2417614 or CH 634 530.

FIG. 1*c* depicts a product group 100 of two folded products 10, 20 of substantially similar size which lay on top of one another with a lateral displacement d, d' in the direction of displacement A. Thus, again projections 14, 24 of substantially similar widths d as well as d' are formed. Such a product group can, for example, be produced by a method analogous to the method disclosed in EP-A 0 936 169 or through the consolidation of two imbricated streams.

FIGS. 1*d* and 1*e* depict a further product group 100 with products 10, 20 of dissimilar size. In FIG. 1*d*, the smaller product 20 is shown with its folded edge 23 flush against the folded edge 13 of the larger product 10 (i.e. s=0).

FIG. 1*f* largely corresponds to FIG. 1*b* with the difference that the inside-lying product 20 is not folded. In a manner analogous to FIG. 1*c*, the non-folded product 20 can also lie on the folded product 10.

FIGS. 1*g* and 1*h* depict product groups 100, which in each case consist of two product pairs 30, 30'. In FIG. 1*g*, the product pairs 30, 30' correspond to FIG. 1*b* and lie on top of one another with a displacement of width s' perpendicular to the direction of displacement A. In FIG. 1*h*, the product pairs 30, 30' substantially correspond to FIG. 1*c* with the difference that the gripped edges 12, 22, 12', 22' within a pair are spaced apart one in front of the other by the distance s. Between the product pairs 30, 30' there is again a displacement of width s' perpendicular to the direction of displacement A. In both cases the displacement s, s' can also have a value of zero (see FIG. 1*i*, 1*m*). The overlapping area 32 in which the gripper preferentially grips is again shown with shading. In order to separate, the lateral projections 14, 14', 24, 24' would be gripped.

FIGS. 1*i*-*m* depict several examples of an arrangement of products in an imbricated formation, in particular, though not necessarily, with the goal of transferring groups of several products to the gripper.

Figure 1I:
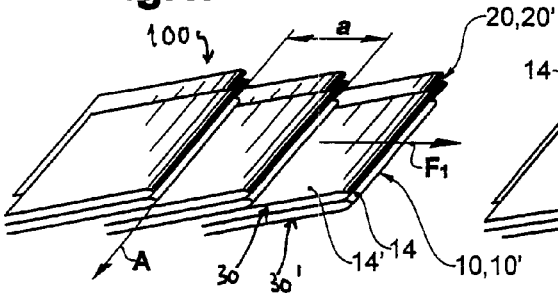

In FIG. 1*i*, the imbricated formation consists of product groups 100, which in each case feature two product pairs 30, 30' of in each case two products 10, 10', 20, 20'. The product pairs 30, 30' correspond to FIG. 1*b*. Within a group 100 they lie on top of one another without displacement relative to one another (s'=0). The group spacing a is constant between two groups that follow one another. This formation is preferentially produced as a simple imbricated formation, consisting of product pairs with the same spacing, composed, e.g. in the method according to EP-A 0013920.

Figure 1K:
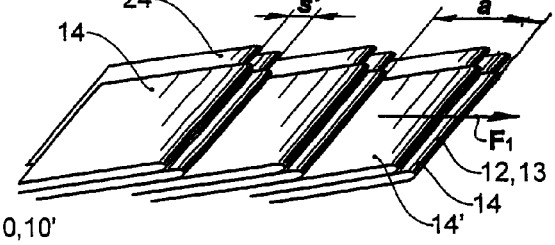

The imbricated formation according to FIG. 1*k* corresponds to FIG. 1*i* with the difference that the product pairs 30, 30' within a product group 100 are displaced relative to one another in a displacement s' in the direction of conveyance F1 (cf. FIG. 1*g*).

Figure 1L:
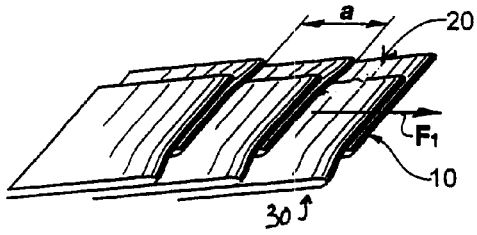
Figure 1M:
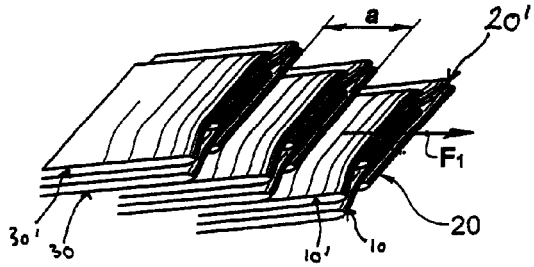

The imbricated formation according to FIG. 1*l* is a simple imbricated stream with group spacing a of product pairs 30, which are assembled according to FIG. 1*c*. FIG. 1*m* corresponds to FIG. 1*i* with the difference that in each case two pairs 30, 30', formed according to FIG. 1*c*, lie on top of one another.

The depicted imbricated streams can not only be used as the incoming formation for the method according to the invention, but also be generated as the outgoing formation by being laid down by the gripper.

Figure 2A:
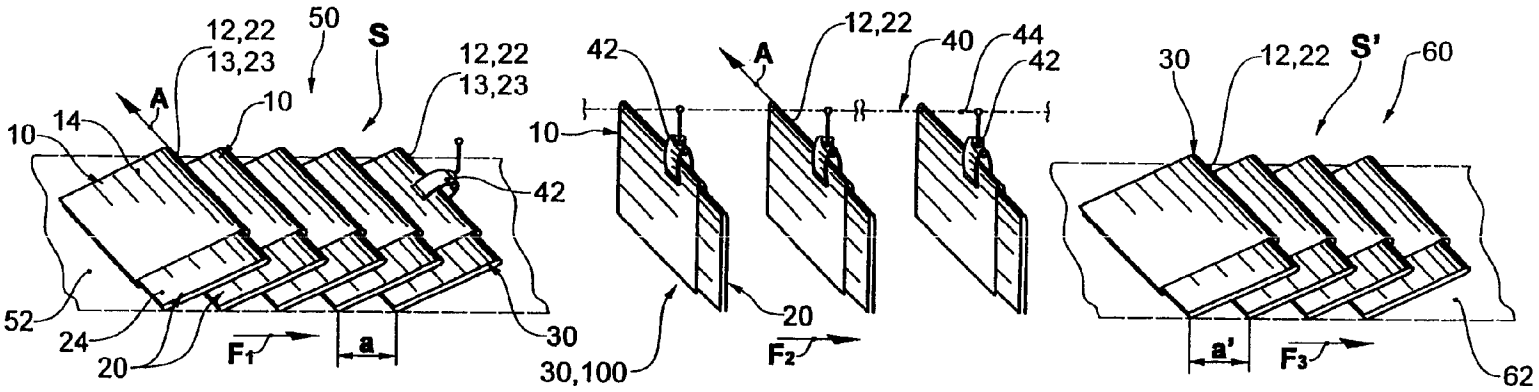
FIG. 2*a* a device for the execution of the conveyance method according to the invention, wherein in each case two products are gripped by a gripper.

FIG. 2*a* gives a schematic depiction of a device for the execution of the method of conveyance according to the invention. It features a gripper conveyor with a plurality of grippers 42 which move along the length of a conveyance line 44. It again features an incoming conveyor 50 as well as an outgoing conveyor 60. Both are designed with a conveyor belt 52, 62 and are thereby equipped to convey the products 10, 20, which are consolidated together in product pairs 30, in an incoming or as the case may be outgoing imbricated stream S, S' in an incoming or as the case may be outgoing direction of conveyance F1, F3. The individually-controllable individual grippers 42 of the gripper conveyor 40 take up the product pairs 30 in a pre-determined way from the incoming imbricated formation S and lay them in the outgoing imbricated formation S' on the conveyor belt 62 of the outgoing conveyor 60. During the conveyance by the gripper conveyor 40, further steps that are not depicted here may be performed. It can also be imagined that instead of an outgoing conveyance device 60 there can, for example, be a staple binding module or another mechanism for post-processing.

The incoming imbricated formation S already consists of product pairs 30 which are assembled for example as in FIG. 1*a*-*c* or 1*e*, i.e. laying within or upon one another with a lateral displacement whereby lateral projections 14, 24 are formed. The product pairs 30 have a constant group spacing a. The direction of displacement A is oriented perpendicularly to the incoming direction of conveyance F1. The folded edges 13, 23 here lie on top and oriented toward the incoming direction of conveyance and are to be gripped by the gripper.

The gripper 42 grips the product pairs 30 in each case in the area of the folded edge 13, 23. The opening and closing movement is controlled in a known manner by controlling mechanisms. The product pairs 30, here hanging, are conveyed in a further direction of conveyance F2 by the gripper conveyor 40 wherein the gripper jaw points downward. The gripper 42 can, however, also have an orientation towards or away from the further direction of conveyance F2. The edges which are opposite from the folded edges 13, 23 of the product 10, 20 can hang freely downward or be supported by some further means not depicted here.

In the outgoing imbricated formation S,' the product pairs 30 have a group spacing a' which can be identical to or different from the original group spacing a. In the examples shown, the orientation of the product pairs 30 in the outgoing imbricated formation S' corresponds to that of the incoming imbricated formation S. However, it is in principle possible that any arbitrary formation can be created, with e.g. with folded edges trailing.

Figure 2B:
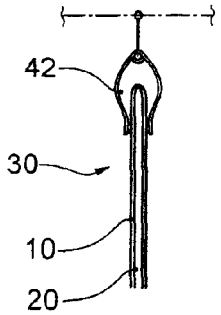
FIGS. 2*b-e* several possibilities for the arrangement of the products within a gripper in a view in the direction of displacement when performing a method according to FIG. 2*a;*
Figure 2C:
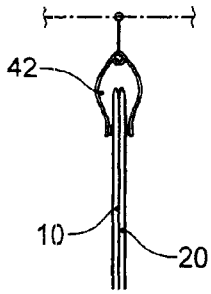
Figure 2D:
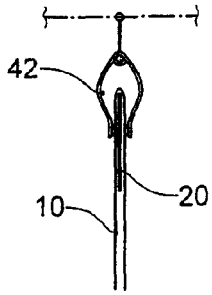
Figure 2E:
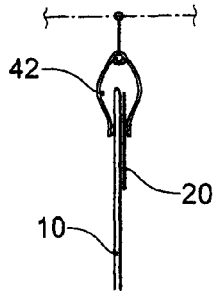

FIGS. 2*b-e* depict views in the direction of displacement A of examples of product groups as well as pairs 100, 30 during transport by the grippers 42 according to FIG. 2*a*. Therefore, the projections 14, 24 are not visible. In each case, the gripper 42 grips in the overlapping area 32 (cf. FIG. 1*a-e*). In FIG. 2*b*, a product pair 30 that is constructed as in FIG. 1*b* or 1*d* is conveyed. In FIG. 2*c* a product pair 30 that is constructed as in FIG. 1*c* is conveyed. In FIG. 2*d* a product pair 30 that is constructed as in FIG. 1*f* is conveyed. In FIG. 2*e* a product pair 30 that is constructed as in FIG. 1*c*, but with the difference that one of the products 20 is not folded, is conveyed.

Figure 3A:
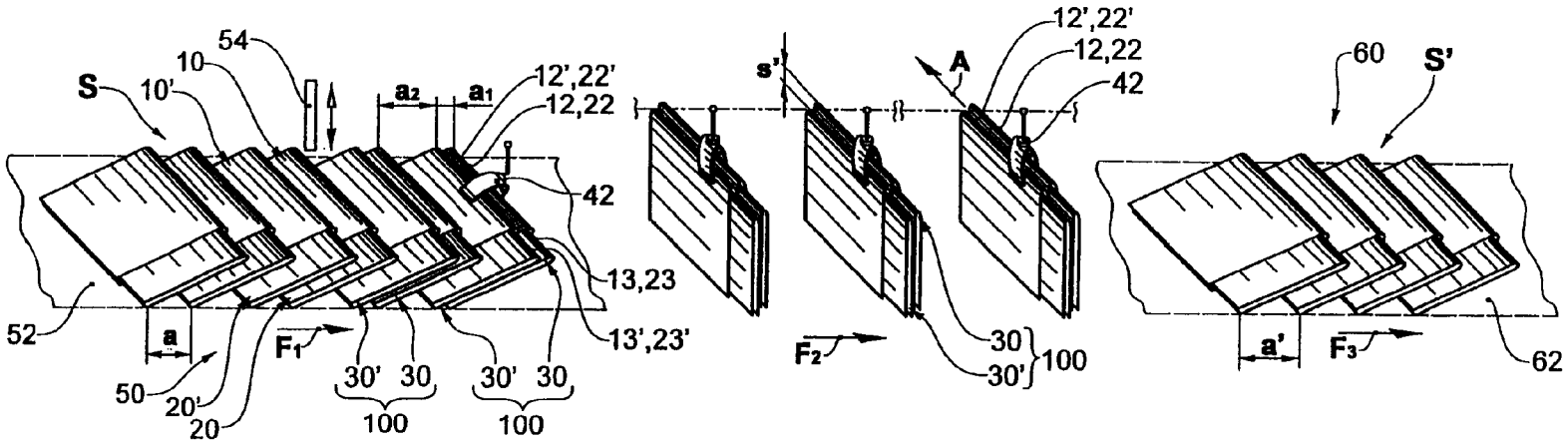
FIG. 3*a* a device for the execution of the conveyance method according to the invention, wherein in each case four products are gripped by a gripper.

FIG. 3*a* depicts the device of FIG. 2*a* in the execution of a variation of the conveyance method according to the invention, in which a product group 100 of in each case four products 10, 10', 20, 20' (as the case may be two product pairs 30, 30') is gripped by a gripper 42. The incoming imbricated formation S is thereby initially constructed as in FIG. 2*a* of product pairs 30, 30' with a regular group spacing a. Through the action of a retarding means 54 the group spacing a is altered, such that the products are pushed together into groups 100 of two or more product pairs 30, 30'. Here two product pairs 30, 30' are in each case dedicated to one group (the product pairs 30, 30' can be either variable or identical). In each case, a product pair 30 has a spacing a1 that is decreased relative to the following product pair 30', and which can also be zero, as well as a spacing a2 that is increased relative to the preceding product pair 30' (a1+a2 corresponds to the group spacing a). The above-mentioned retarding means 54 is for example an impulse that is timed to and brought to bear on the imbricated stream S and moves the product pairs 30, 30' together by its action thereupon. However, other methods are possible in order that in each case two or more product pairs 30, 30' are transferred into a gripper 42. It is also possible that the assembly of the product groups 100 for this purpose is accomplished by the action of the gripper 42 itself, without necessitating that the product pairs 30, 30' be pushed together beforehand (see e.g. FIG. 5*b*).

Here the gripper 42 grips in each case two product pairs 30, 30' in the area of the leading edges 12, 22, 12', 22', which here correspond to the folded edges 13, 23, 13', 23'. The product pairs 30, 30' in the gripper have a displacement relative to one another in a direction s perpendicular to the direction of displacement A, which may, but need not, correspond to the spacing a1. The displacement a can also be zero.

The gripper 42 lays the product pairs 30, 30' in groups on the conveyor belt 62 of the outgoing conveyor 60. The outgoing imbricated formation can already upon being laid down feature a regular group spacing a', which corresponds, e.g. to the displacement s'. Alternatively, an alternative group spacing can be created here and either retained or later regularized.

Figure 3B:
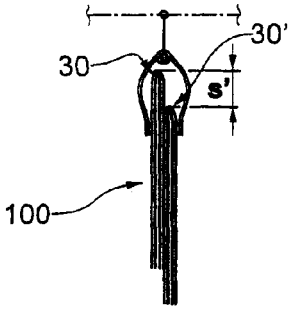
FIGS. 3*b-e* several possibilities for the arrangement of products within a gripper in a view in the direction of displacement when performing a method according to FIG. 3*a;*
Figure 3C:
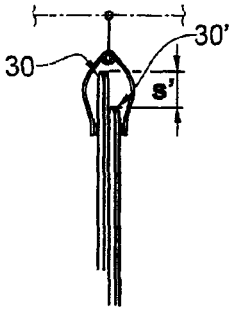
Figure 3D:
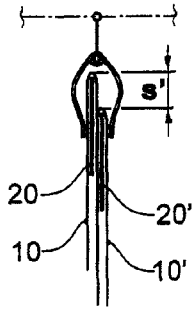
Figure 3E:
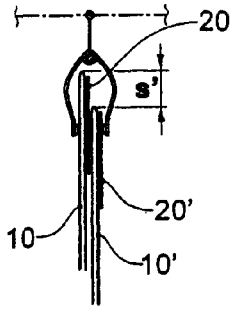

FIG. 3*b-e* depict examples of product groups 100, consisting in each case of two product pairs 30, 30', shown in a view in the direction of displacement A during transportation in the gripper 42 of the device according to FIG. 3*a*. The product pairs 30, 30' have in each case a displacement s in a direction perpendicular to the direction of displacement A. In FIG. 3*b*, two product pairs 30, 30' corresponding to FIG. 1*g* are held. In FIG. 3*c*, two product pairs corresponding to FIG. 1*h* (with s=0 and s'>0) are held. FIGS. 3*d* and 3*e* correspond to FIG. 3*b* as well as 3*c*, with the difference that in each case one of the products 20, 20' of the product pair 30, 30' is not folded.

Figure 4:
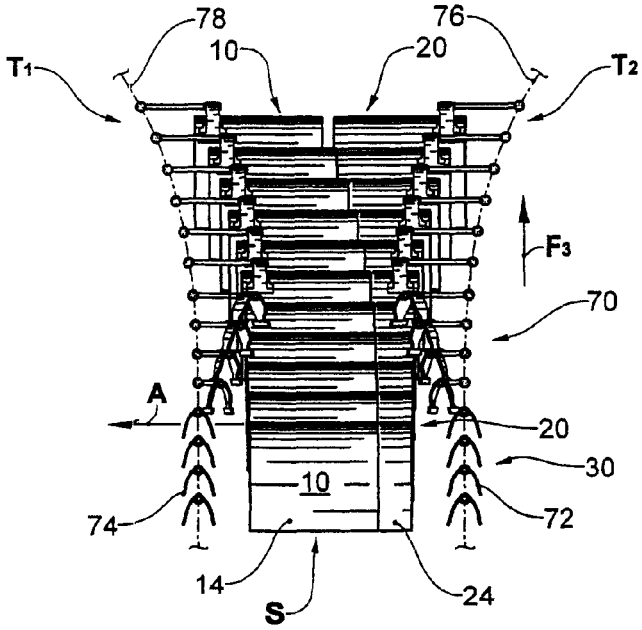
FIG. 4 the division of an imbricated stream consisting of a plurality of product groups into two sub-streams.

FIG. 4 depicts a possibility for the further processing of the outgoing imbricated formation S' that is appropriate in order to further separate the product pairs 30 into single products 10, 20, which are respectively further transported in separated imbricated sub-streams T1, T2. To that end, a separation device 70 features two groups of holding elements 72, 74 which respectively are movable along the length of a first as well as a second movement line 76, 78. These holding elements 72, 74 are able to grip onto the lateral projections 14, 24 and pull the products apart from each other by transporting them in the outgoing direction of conveyance F3 with a component of movement perpendicular to the direction of displacement A. Instead of separate, movable holding elements 72, 74, continuous belts or stationary conveyance rollers may be present. A design can be utilized as per DE-A 2417614, CH 634 530 or EP-A 0 936 169, which are incorporated by reference.

By these means, formations with irregular product spacing, products in imbricated formations here of product units of several products that are stacked congruently or stacked one on top of another or displaced relative to one another, or formations consisting of two or more imbricated sub-formations laying on top of one another can also be pulled apart into sub-formations in a direction transverse to the direction of conveyance.

Figure 5A:
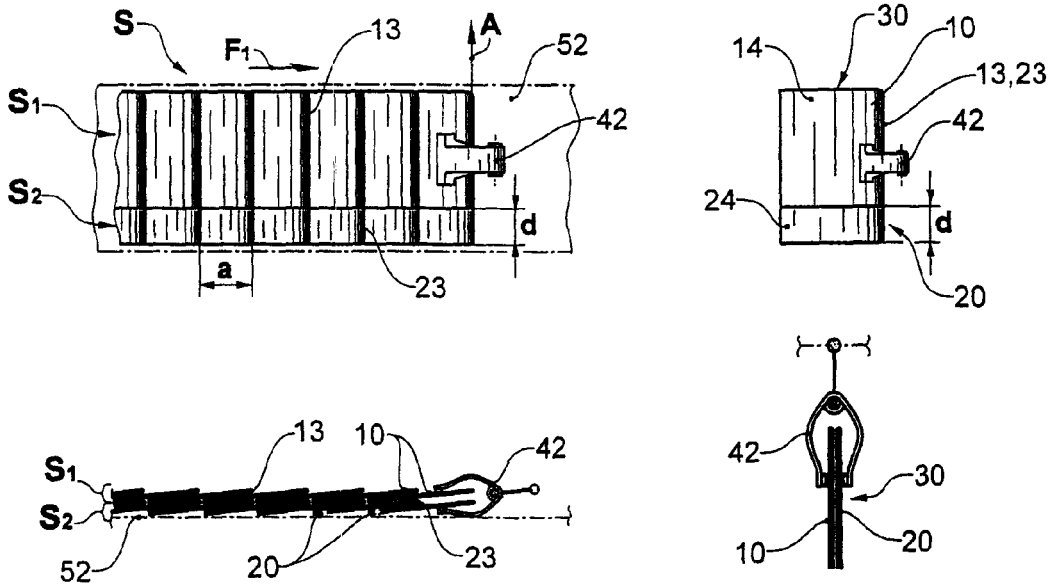
FIGS. 5*a+b* a further example of the execution of the method according to the invention in overview and, respectively, side view, wherein in each case two products are taken from an imbricated formation consisting of two imbricated sub-streams lying on top of one another.
Figure 5B:
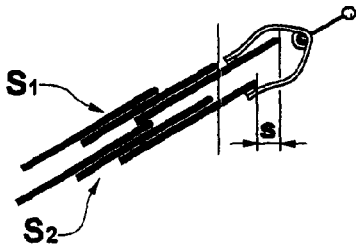
FIG. 5*c* a modification of the method according to FIG. 5*a+b;*

FIGS. 5*a*+*b* depict an overview as well as a side view of a further example of the execution of the method according to the invention. An incoming imbricated formation S consists of two imbricated sub-streams S1, S2 with in each case identical group spacing a, which lie on top of one another on a conveyor belt 52. The imbricated sub-streams S1, S2 consist of first as well as second products 10, 20, which can be, but need not be, folded. The products 10, 20 can also feature sub-products (not shown here, but see FIG. 6*b*). The leading edges 13, 23 of the products 10, 20, which are later gripped, lie in each case on top of the preceding product. They define a direction of displacement A which lies perpendicular to the incoming direction of displacement F1. In this direction, the imbricated sub-streams S1, S2 at hand have a displacement d which is composed as the products 10 of the upper imbricated sub-stream S1 are laid upon the lower imbricated sub-stream S2. A method for this layering of imbricated streams is disclosed in WO 03/053831, which is incorporated by reference.

According to the invention, the gripper 42 here grips, in each case, two products from the resulting imbricated formation S, wherein a product 10 from the upper imbricated sub-stream S1 as well as a product 20 from the lower imbricated sub-stream S2 is grasped. Because of the displacement d of the imbricated sub-streams S1, S2, a product pair 30 is formed in the gripper 42, in which the individual products 10, 20 lie on top of one another and again are displaced relative to one another to the extent of the displacement d. The product pair 30 is depicted in, e.g. FIG. 1*c*.

Figure 5C:
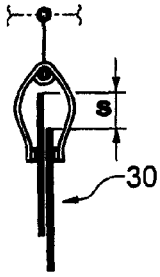

The imbricated sub-streams S1, S2 can also be shifted out of phase, so that a product pair is formed with a displacement d in the direction of the product edge as well as a displacement s perpendicular thereto (FIG. 1*a*, FIG. 5*c*).

Figure 6A:
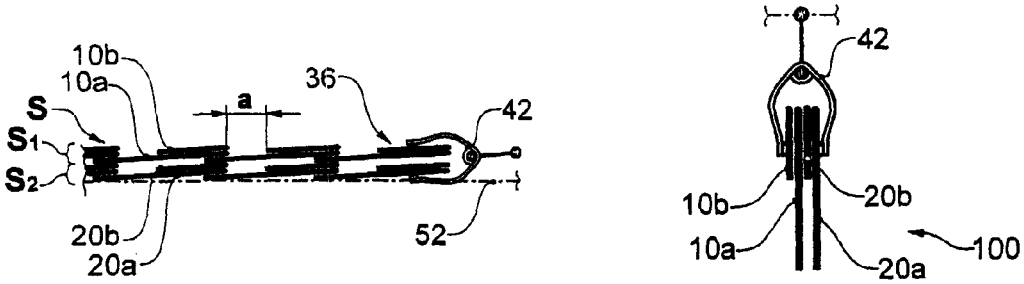
FIGS. 6*a+b*, 7*a+b* further examples of the execution of the method according to the invention in overview and, respectively, side view, wherein in each case four products are taken from an imbricated formation consisting of two imbricated sub-streams lying on top of one another.

FIGS. 6*a*+*b*, 7*a*+*b* depict in side view (FIG. 6*a*, 7*a*) as well as overview (6*b*, 7*b*) further examples of a method according to the invention, in which the incoming imbricated formation S consists of two imbricated sub-streams S1, S2, one lying on top of the other. The imbricated sub-streams S1, S2 consist in each case of several product units, as here two sub-products, wherein the product units have a regular group spacing a between one another. The FIGS. 6*b*, 7*b* depict two variants of how the imbricated sub-streams S1 S2 can appear, in order to reach the goal according to the invention that into the gripper 42 may be transferred the gripped edges of a product group 100 with a sideways displacement of at least two products perpendicularly to direction A. The side view FIG. 6*a*, 7*a* is the same for both variants.

In FIG. 6*b*, the product unit in each case consists of two sub-products 10*a*, 10*b* and as the case may be 20*a*, 20*b*, which lie on one another without relative displacement and can in each case be identified with a product 10, 20 from the above examples. As in FIGS. 5*a*+*b*, the resulting products 10, 20 are arranged in separate imbricated sub-streams S1, S2 and laid on top of each other with a lateral displacement d. A gripper 42 grips, in each case, two products 10, 20 consisting of the described sub-products 10*a*, 10*b* and as the case may be 20*a*, 20*b*. The sub-products 10*a*, 10*b* from the upper imbricated sub-stream S1 therefore have a displacement d relative to the sub-products 20*a*, 20*b* from the lower imbricated sub-stream S2, such that overall, a product group 100 with the desired characteristics can be composed.

In FIG. 7*b*, the product units consist of product pairs 30, 30' with in each case two products 10, 20, 10', 20', which already feature a displacement d relative to one another. The product pairs 30, 30' are, e.g., as featured in FIG. 1*a-f*. The imbricated sub-streams S1, S2 are here laid on top of one another without a sideways displacement. The gripped product groups correspond to, e.g., FIG. 1*g* or 1*h* (with s'=0).

The concepts from FIGS. 6*b* and 7*b* can also be combined, e.g. in that the imbricated sub-streams S1, S2 may be laid on top of one another with an additional sideways displacement. It is also possible, in each case, that only one product or more than two products can exist in one product unit; furthermore the numbers of products per product unit in the imbricated sub-streams do not need to be the same.

FIG. 8 depicts, in a manner analogous to FIG. 5*c*, the composition of a product group 100, in which in each case two products are situated with an additional displacement s perpendicular to the direction of displacement A, which is created by a phase shift of size s between the imbricated sub-streams S1, S2.

In the examples of FIGS. 5*a-c*, 6*a*+*b*, 7*a*+*b*, 8, there may also be more than two imbricated sub-streams with constant group spacing a laid on top of one another, to produce in the same manner with a gripper 42 product groups 100 consisting of more than two, or as the case may be more than four, products.

Figure 9:
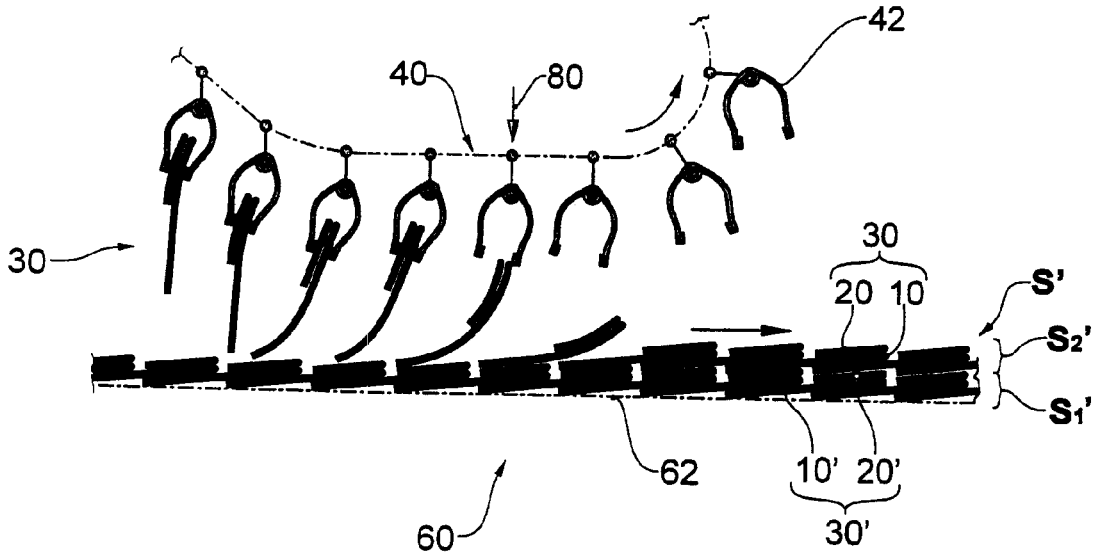
FIG. 9 an example of the composition of an outgoing imbricated formation consisting of two imbricated sub-formations.

FIG. 9 depicts schematically a further example of the production of an outgoing imbricated formation S', which can be further transported by an outgoing conveyor 60. An outgoing imbricated sub-stream S1', consisting of single product pairs 30', has already been formed on the conveyor belt 62 of the outgoing conveyor 60. Through the laying thereon of further pairs of products 30 a second outgoing imbricated sub-stream S2' is created as the gripper 42 is opened at a common release point or, as the case may be, transfer point 80. The first imbricated sub-stream S1' can have an arbitrary origin, e.g. from out of a storage place.

The examples depicted make clear that the invention makes possible a high degree of flexibility. In particular, product groups of nearly any arbitrary configuration, consisting of identical or also variable folded or unfolded products, can be transferred into the gripper. This occurs very simply because the products are taken in groups out of a simple imbricated formation or a more complex formation consisting of several imbricated sub-streams lying on top of one another. The conveyance capacity of the gripper conveyor is significantly increased thereby. If desired, the later whole or partial separation of the product groups into single products can be achieved by simple means, due to the sideways projections between at least two products in a product group. To this end, the product groups are preferably laid in an outgoing imbricated formation.

Besides by grippers, the product groups here depicted can be conveyed by another means of conveyance that allows a controlled and defined movement. Here may be considered a belt conveyor that preferentially clamps the products between two belts, preferably in an imbricated formation. The products can also be clamped at a product edge that runs in the direction of conveyance. In this case the displacement of the product in a product group or as the case may be a product pair is preferentially transverse to the gripped edge, i.e. transverse to the direction of conveyance.

In addition, also without a transfer to a gripper conveyor, forming an imbricated formation that consists of product groups which comprise two or more products, at least one of which comprises a displacement transverse to the direction of conveyance or transverse to the folded edge (direction of displacement), out of a simple imbricated formation has advantages. In particular in the case of a displacement transverse to the direction of conveyance, an extremely simple separation of the product groups ensues, in which the protruding product is pulled out in the direction of displacement.

The invention claimed is:

1. Method for the conveyance of planar products, in particular printed products, wherein a product group consists of at least two products, comprising the following steps:

arranging the products of the product group such that at least one of the products is offset relative to the remaining product or products of the product group;

thereby forming at least a first projection, and a second projection in the offset direction, wherein the first projection is associated with at least one product of the product group and a second projection is associated with the remaining product or products of the product group;

gripping the product group in the area of a product edge of at least one of the products of said group by a gripper of a gripper conveyor, such that the direction of the gripped product edge is parallel to the offset direction of the at least one of the products from the remaining product or products;

conveying the product group in a direction of conveyance.

2. The method according to claim 1, wherein at least one product of the product group is folded and comprises a folded edge whose direction is parallel to the offset direction of the at least one of the products from the remaining product or products.

3. The method according to claim 2, wherein at least two products of the product group are folded and wherein the arranging step comprises arranging the products such that their folded edges run parallel to one another.

4. The method according to claim 1, comprising the step of conveying the product group in a direction of conveyance that is oriented perpendicularly to the offset direction.

5. The method according to claim 1, wherein a product group comprises at least two products and wherein the arranging step comprises arranging the products lying inside of one other or on top of one other, such that they are aligned flush together with respect to the gripped product edge.

6. The method according to claim 1, wherein a product group features at least four products forming at least two product pairs, and wherein the arranging step comprises arranging the products such that at least one product of one product pair is offset in a direction parallel to the gripped product edge relative to the other product of the respective product pair.

7. The method according to claim 6, wherein the gripped product edges of a product of a product pair are shifted relative to the gripped product edges of a product of a further product pair, in a direction transverse to the offset direction.

8. The method according to claim 1, further comprising the steps of:

conveying the products in an incoming imbricated formation in an incoming direction of conveyance;

gripping the products by grippers of the gripper conveyor in the area of their leading or trailing product edges.

9. The method according to claim 8, wherein the incoming imbricated formation comprises several product units, wherein the products of a product unit at least partly overlap each other and wherein at least one of the products of a product unit is offset, in a direction parallel to the preceding or trailing product edges, relative to the other product or products of the product unit, such that in each case a projection is formed in the offset direction, wherein a first projection is associated with at least one product of the product unit and a second projection is associated with the remaining product or products of the product unit, and wherein the gripping step comprises transferring each product unit into a gripper.

10. The method according to claim 8, wherein the incoming imbricated formation comprises two imbricated sub-streams that lie on top of one another.

11. The method according to claim 10, wherein the imbricated sub-streams lie on top of one another with an offset transverse to the incoming direction of conveyance.

12. The method according to claim 8, comprising the step of generating the incoming imbricated formation by a rotary printing press or by unwinding stored products from a winding roll.

13. The method according to claim 1, further comprising the step of opening the gripper at a transfer location and transferring the products to an outgoing conveyor in such a manner that an outgoing imbricated formation is composed.

14. The method according to claim 13, comprising forming the outgoing imbricated formation by laying down the products upon an existing imbricated stream.

15. The method according to claim 13, further comprising the step of separating the outgoing imbricated formation into two sub-streams by gripping the products in the outgoing imbricated formation at the projections and pulling them apart from one another in the offset direction.

16. A method, according to claim 1, for the conveyance of planar products, comprising the following steps:

generating an imbricated formation of product groups, and thereby arranging the product such that the product groups at least partially overlap each other with a constant group spacing and such that at least one of the products of a product group is offset relative to the other product or products in the product group, in such a way that in each case a projection is formed in the offset direction, wherein a first projection is associated with at least one product and a second projection is associated with the other product or products of the product group;

conveying the imbricated formation in a direction of conveyance, wherein the direction of conveyance is transverse to the offset direction.

17. The method according to claim 16, further comprising the step of transferring the product groups into grippers of a gripper conveyor and thereby maintaining the offset within the products of one product group.

18. The method according to claim 16, wherein a product group comprises at least two product pairs, which at least partially overlap each other and comprise relative to one another an offset seen in the incoming direction of conveyance, which is smaller than the group spacing.

19. A device for the conveyance of planar products, comprising an incoming conveyor for the conveyance of products and a gripper conveyor with a gripper that grips and conveys a product group in such a way that in each case at least one of the products of a product group is offset relative to the other product or products of the product group in a direction parallel to the gripped product edge or a folded edge of the product group.

20. The device according to claim 19, wherein the incoming conveyor comprises a conveyor belt that conveys the products in an imbricated formation.

21. The device according to claim 19, further comprising an outgoing conveyor that takes over the products from the gripper conveyor and conveys them in an outgoing imbricated formation in an outgoing direction of conveyance.

22. The device according to claim 21, wherein at least a first projection, and a second projection in the offset direction are formed, wherein the first projection is associated with at least one product of the product group and a second projection is associated with the remaining product or products of the product group, and wherein the outgoing conveyor comprises holding means that grips the products in the outgoing imbricated formation at the projections and pulls them apart from each other in the offset direction, such that the outgoing imbricated formation is separated into two sub-streams.

* * * * *